US006257350B1

(12) United States Patent
Draney et al.

(10) Patent No.: US 6,257,350 B1
(45) Date of Patent: Jul. 10, 2001

(54) MULTIPLE POSITION STAKING SYSTEM FOR A HORIZONTAL DIRECTIONAL DRILL

(75) Inventors: Robert G. Draney, Derby, KS (US); Donald C. Sassor, Osceloa, WI (US); Dmitry I. Spivak, Eagan, MN (US); Jeffrey S. Volden, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/503,600

(22) Filed: Feb. 11, 2000

(51) Int. Cl.[7] ..... F21B 15/04

(52) U.S. Cl. ..... 173/32; 173/37; 173/42; 173/187

(58) Field of Search ..... 173/32, 31, 37, 173/28, 42, 45, 50, 38, 187, 189, 192; 254/29 R, 30, 18; 408/236, 712

(56) References Cited

U.S. PATENT DOCUMENTS 337,968 * 3/1886 Manning ..... 173/32
3,559,750 * 2/1971 Mares ..... 173/45
3,797,587 * 3/1974 Klein ..... 173/37
3,814,192 * 6/1974 Steen ..... 173/187
3,837,757 * 9/1974 Levine ..... 408/236
3,842,610 * 10/1974 Willis et al. ..... 173/46
4,105,079 * 8/1978 Schmidt ..... 173/42
4,468,159 * 8/1984 Oster ..... 408/236
6,131,674 * 10/2000 Draney et al. ..... 173/32

* cited by examiner

*Primary Examiner*—Scott A. Smith
(74) *Attorney, Agent, or Firm*—Richard G. Lione; Brinks Hofer Gilson & Lione

(57) ABSTRACT

A multiple position stakedown assembly for a horizontal directional drill machine which installs stakes into the ground in a variety of different locations with a single drive head. The stakedown assembly includes a vertical tower that is rotatably mounted on a base plate. Locator ports for the stakes are provided in the base plate in a segmentally circular pattern around the tower. A drive head cantilevered from the top of the tower rotates with the tower to positions where it can install stakes through any of the ports.

5 Claims, 2 Drawing Sheets

MULTIPLE POSITION STAKING SYSTEM FOR A HORIZONTAL DIRECTIONAL DRILL

FIELD OF THE INVENTION

The present invention relates generally to horizontal directional drill machines. It relates particularly to a stakedown assembly for a horizontal directional drill machine.

BACKGROUND OF THE INVENTION

A horizontal directional drill machine is a common and well-known machine for installing pipes beneath the ground and generally parallel to the surface. These machines are used in many different applications and are available in a wide range of sizes. Typical applications where a horizontal directional drill machine might be used include the installation of fiber optic cables, electrical cables, gas lines, water systems, or sewer systems. Horizontal directional drill machines are commonly rated in terms of pull-back capacity. Some machines for smaller applications have as little as five thousand pounds of pull-back capacity. Other machines are available with a pull-back capacity of as much as one million pounds.

One alternative to a horizontal directional drill machine is the traditional trencher machine. A trencher machine simply digs a trench into the ground, and after (for example) pipe is laid down in the bottom of the trench, the trench is filled and the pipe is buried. The advantage of a horizontal directional drill machine over a trenching machine is that a pipe can be buried in the ground over long distances without digging a trench. Thus, a horizontal directional drill is particularly desirable when a trench would be difficult or too costly to dig. For example, a horizontal directional drill machine finds particularly advantageous application for installing pipes under roadways, where destruction of the road is expensive and inconvenient to travelers, or under a waterway like a river, where trenching would be impossible.

A unique aspect of a horizontal directional drill machine is the special drill head that is attached to the front end of a pipe to be laid. The drill head has an angled shape which allows the operator to change the direction of the pipe after it has entered the ground. Direction changes are achieved by stopping the pipe and drill head rotation and orienting the drill head at a desired angle. Then, by pushing on the drill pipe without rotating it, the drill head and attached pipe will veer in the desired direction. Thus, by effecting directional changes to pipe travel, a pipe might enter the ground at an angle, travel horizontally over a long distance, and exit the ground at another angle. This ability to change the direction of pipe travel also allows the operator to steer the pipe around underground obstacles like boulders.

In addition to pushing forces which must be applied to the pipe as it is inserted, it is often necessary to pull back on the pipe. This may be necessary when a direction change is not completely successful on the first attempt, or when an underground obstacle like a boulder is encountered. The machine then pulls the pipe and drill head back to permit a direction change.

The push and pull forces that a horizontal directional drill machine must apply to the drill pipe frequently exceed the weight of the machine itself. Therefore, a system is required to anchor the machine and resist these forces. The most common system for anchoring the drill machine comprises the use of stakes mounted on the machine body which are screwed into the ground. The stakes have flighting on their tips and are driven into the ground by applying simultaneous rotational and vertical driving forces to each stake. To drive and remove these stakes, a stakedown assembly is conventionally provided on the end of the drill machine where the drill head enters the ground.

A common stakedown assembly in the prior art includes a single drive head which is fixed in one position. This type of stakedown assembly provides a single location, predetermined by the manufacturer, at which a stake can be driven. Other stakedown assemblies, also in the prior art, have two drive heads so that two stakes can be installed into the ground for extra holding strength, or a single stake can be installed in either of the two available locations. Depending on the push-pull forces required and the texture of the ground material, however, a single stake may not be adequate to securely hold the machine in place. Several stakes may be required. The subsurface of the underlying ground may contain obstacles such as large rocks or previously buried pipes or lines which limit the locations where a stake may be installed. So, the two drive head assembly is frequently inadequate. Furthermore, the two drive head assembly is limited in the number of possible stake installation locations and suffers from the higher cost and added complexity associated with the use of dual components.

BRIEF SUMMARY OF THE INVENTION

It is an object of the invention to provide a new and improved stakedown assembly for a horizontal directional drill machine.

Another object is to provide a stakedown assembly which affords multiple position stakedown options in a simple and inexpensive construction.

The stakedown assembly of the present invention includes a tower mounted on a base plate for rotation about its vertical axis. The base plate has stake guide holes arranged in a semi-circular pattern, at equal distances from the tower. Connected to the top of the tower is a drive head which is mounted on an arm cantilevered over the semi-circle defined by the guide holes. A sliding connection allows the arm to travel vertically along the tower. A hydraulic cylinder connects the arm with the bottom of the tower. A motor on the cantilevered arm powers the drive head for rotating a stake.

The drive head can be positioned directly over each of the guide holes by rotating the tower about its axis. A locking mechanism is provided for locking the arm of the drive head in position over the desired guide hole. The cylinder is actuated to force the arm and stake downwardly. The motor is actuated to rotate the stake.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION OF THE INVENTION

Figure 1:
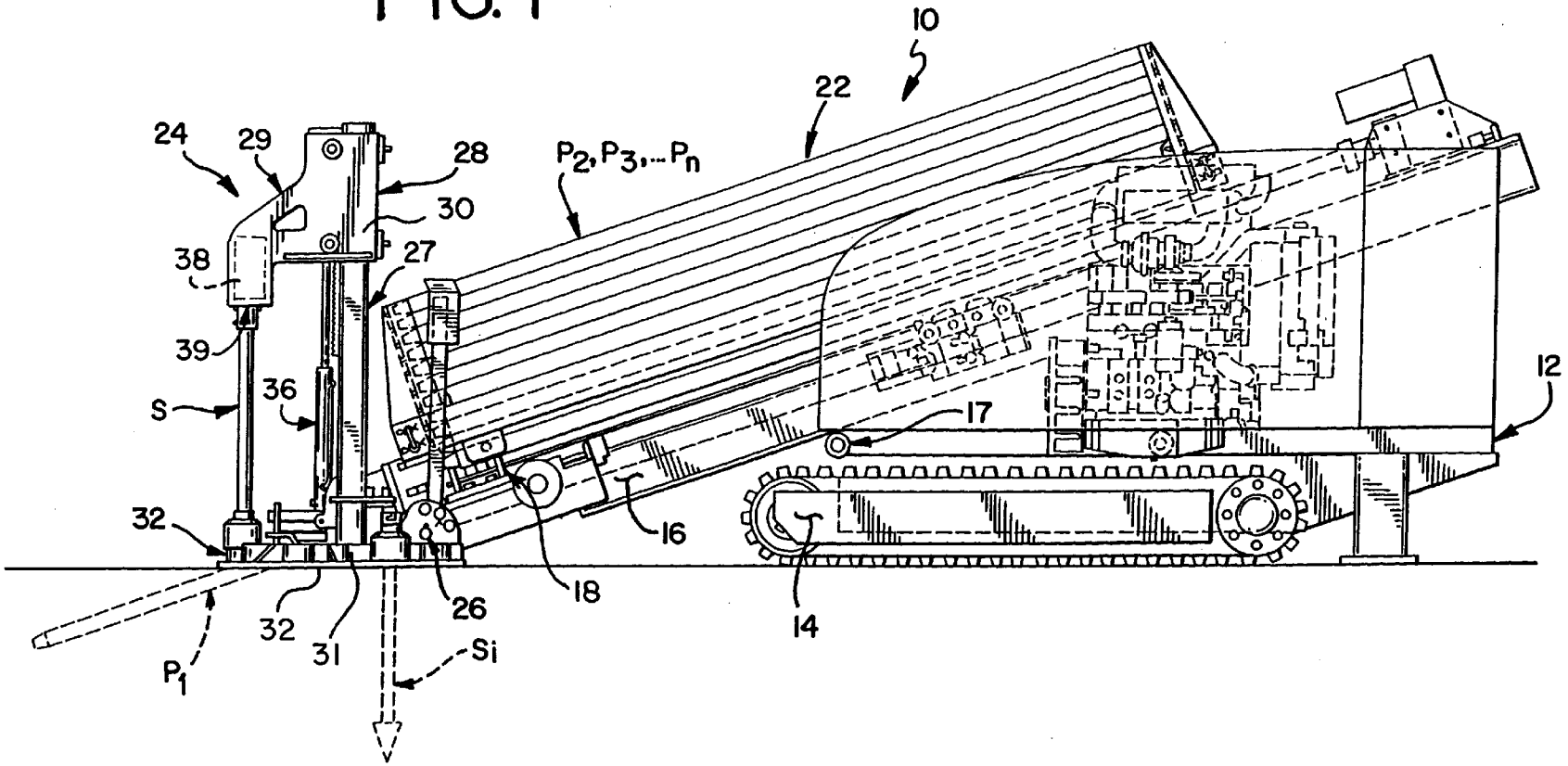
FIG. 1 is a side elevational view of a horizontal directional drill machine, showing the drill in its operating mode.

Referring now to the drawings, and particularly to FIG. 1, a horizontal directional drill machine is shown generally at 10. The drill machine 10 includes a frame 12 supported by driven tracks 14 for moving the drill machine 10 from place to place.

The drill machine 10 includes a longitudinally elongated boom 16 pivotally mounted on the front end of the frame 12, as at 17. A conventional pipe drill assembly 18 is mounted on the boom 16, extending coextensively therewith. The drill assembly 18 is designed to drill a series of pipe sections $P_1$, $P_2$, $P_3$, et seq., into the ground, in sequence.

In the operating mode of the drill machine 10, the boom 16 is pivoted upward away from the frame 12 so that pipe section $P_1$ . extends from the drill assembly 18 and intersects the ground at an angle. A special drill head (not shown) is attached to the front end of the first drill pipe section $P_1$. In order to drill the pipe section $P_1$ into the ground and make any desired directional changes in its path, a variety of push, pull, and rotational forces are applied to the pipe section $P_1$ by the drill assembly 18. The manner in which the drill assembly 18 applies these forces to the drill pipe section $P_1$ are not described, but are well known to those skilled in the art.

As the first pipe section $P_1$ is drilled into the ground, new pipe sections $P_2$, $P_3$, et seq., are successively attached to the rear end of the preceding pipe sections. A cartridge 22 of pipe sections $P_2$, $P_3$, et seq. is provided on the boom 16 for storing these additional pipe sections, and a semi-automatic or fully automatic loader (not shown) may be provided for attaching them to the preceding pipe sections.

A stakedown assembly 24 is connected to the front end of the drill machine 10. The stakedown assembly 24 is attached to forward end of the boom 16 at a pivot connection 26, which allows the stakedown assembly 24 to be oriented level with the ground surface when the boom is tilted. A coupling such as described in concurrently filed Draney et al. U.S. Patent application Ser. No. 09/495,136 filed Jan. 31, 2000 may be provided for quickly and easily connecting the stakedown assembly to the drill machine 10, or disconnecting it.

Figure 2:
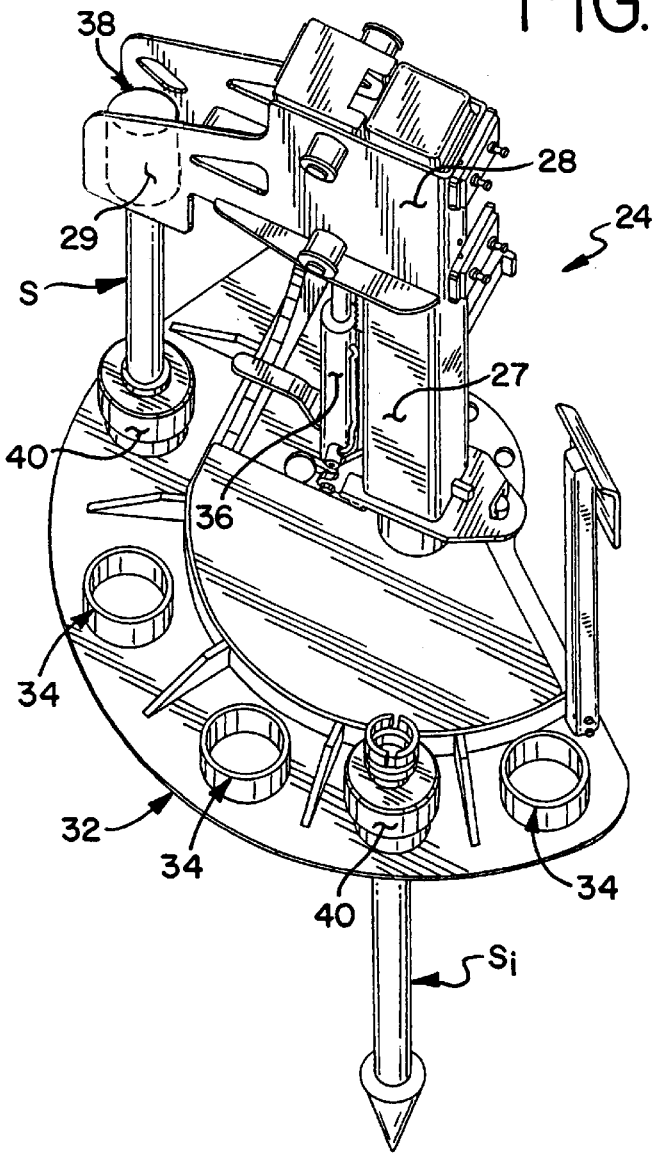
FIG. 2 is a top plan view of the forward end of a horizontal directional drill, including a stakedown assembly embodying features of the invention.
Figure 3:
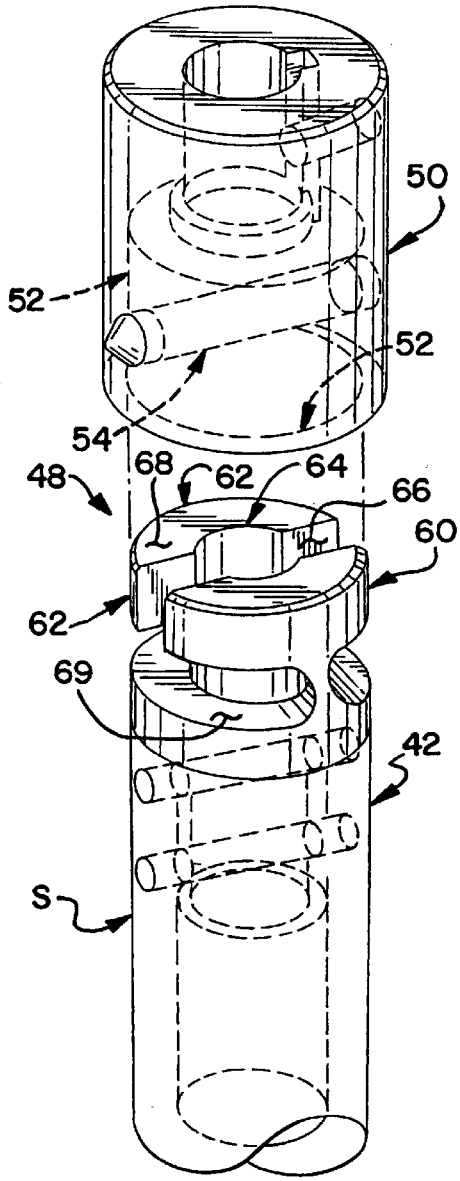
FIG. 3 is a perspective view of the stakedown assembly, with one stake driven into the ground and a second stake positioned for driving under the drive head.

Turning now to FIGS. 2 and 3, a stakedown assembly 24 is shown in greater detail. The stakedown assembly 24 includes a tower 27 mounted on a base plate 32 at a connection 31 which permits the tower 27 to rotate about its vertical axis. A drive head 28 is attached to the tower 27 through a sleeve 30 which permits longitudinal sliding along the tower 27, and a cantilevered arm 29 on which the drive head 28 is mounted.

The lower end of a hydraulic cylinder 36 is pivotally attached to the tower 27, while the upper end is pivotally attached to the arm 29. Thus, the arm 29 and drive head 28 can be driven in a vertical direction by the hydraulic cylinder 36. A rack and pinion drive connection, as described in concurrently filed Draney et al. U.S. patent application Ser. No. 09/501,875 filed Feb. 10, 2000 may be used for this.

The base plate 32 has a series of stake locator ports 34 extending vertically through it, for receiving stakes S when they are installed. These ports 34 are arranged in a segmentally-circular pattern at equal distances from the tower's 27 axis of rotation. In the preferred embodiment, five locator ports 34 are provided on a circle segment whose center is the tower 27. The cantilevered arm 29 extends outwardly over the path of the ports 34 so that the drive head 28 can be positioned over any one of the holes 34 as the tower 27 is rotated.

Opposite the series of ports 34 on the base plate 32, a series of locking pin holes 33 are arranged in a semi-circular pattern adjacent the tower 27. A lock plate 42 is rigidly attached to the tower 27 at its lower end. A locking pin hole 43 in the lock plate 42 can be aligned with any hole 34 and the plate 42 then locked to the base plate 32 with a locking pin 44.

A rotational drive motor 38 is mounted in the drive head 28 on the free end of the cantilevered arm 29. By rotating the tower 27, the output shaft 39 of the motor 38 can be positioned over any one of the guide holes 34. The tower is rotated manually by the operator.

To operate the multiple position stakedown assembly 24, the desired number of stakes S to be installed, and their placement, is first determined by testing soil conditions and locating any underground obstacles. The drive head 28 is rotated on its cantilevered arm 29 until it is over a desired guide hole 35, and locked into position. The bottom end of a stake S is positioned in the desired guide hole 35, and the top end of the stake S is attached to the drive shaft 39 of the motor 38. A coupling as described in concurrently filed Draney et al. U.S. patent application Ser. No. 09/500,820 filed Feb. 10, 2000 may be used to quickly and easily attach the stake S to the drive shaft 39. The drive motor 38 and hydraulic cylinder 36 are then simultaneously operated to apply the rotational and vertical forces necessary to install stake S into the ground.

The installed stake S is then clamped to the base plate 32. To this end, a cap 40 is installed on each of the stakes S. The cap 40 has an inner diameter clearance hole through its center which is large enough to provide a sliding fit between the cap 40 and the stake S, but is smaller than a lower coupler member 60 which is fixedly attached to the top end of the stake S. Because its outer diameter is larger than that of the guide holes 34, the cap 40 is sandwiched between the base plate 32 and the lower coupler member 60 when the stake S is fully driven into the ground. After disconnecting the first installed stake S from the drive shaft 39, additional stakes S can be installed. To do so, the drive head 28 is rotated to a new position and the stake installation process is repeated.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

What is claimed is:

1. A horizontal directional pipe drill machine, comprising:

a) a boom mounted on a frame;

b) a pipe drill assembly mounted on said boom and adapted to drill a series of pipe sections into the ground; and c) a stake down assembly connected to the boom;

d) said stake down assembly including a base member adapted to rest on the ground, a tower mounted on said base member for rotation about an axis extending perpendicularly from said base member, a cantilevered arm extending radially from said tower, and a stake drive head mounted on said arm in radially displaced relationship from said tower;

e) said stake down assembly further including a plurality of stake locator ports formed through said base member in spaced relationship with each other on a segment of a circle whose axis is the axis of rotation of the tower;

f) said tower being rotatable on said base to selectively bring said drive head into a position over each of said plurality of stake locator ports;

g) said stake down assembly further including a locking device for locking said tower in a selected rotational position.

2. The pipe drill machine of claim 1 further characterized in that:

a) said locking device includes a locking hole in said base member corresponding to each one of said locator ports; and b) a locking member for connecting said tower to a selected one of said locking holes.

3. The pipe drill machine of claim 1 further characterized in that:

a) said base member comprises a steel plate;

b) each of said locator holes being formed through said steel plate.

4. The pipe drill machine of claim 1 further characterized in that:

a) said cantilevered arm is mounted on said tower for vertical movement relative to said tower.

5. The pipe drill machine of claim 1 further characterized in that:

a) said stake drive head comprises a rotational drive motor for rotating a stake; and b) means for locking said stake to said base member.

* * * * *